US006333605B1

(12) United States Patent
Grouev et al.

(10) Patent No.: US 6,333,605 B1
(45) Date of Patent: Dec. 25, 2001

(54) LIGHT MODULATING ELECTRONIC BALLAST

(75) Inventors: Gueorgui L. Grouev, Arlington Heights; Kent E. Crouse, Schaumburg; Donald G. Huvaere, Palatine; William L. Keith, Algonquin, all of IL (US)

(73) Assignee: Energy Savings, Inc., Schaumburg, IL (US)

( * ) Notice: Subject to any disclaimer, the term of this patent is extended or adjusted under 35 U.S.C. 154(b) by 0 days.

(21) Appl. No.: 09/431,822

(22) Filed: Nov. 2, 1999

(51) Int. Cl.[7] ..... H05B 37/02
(52) U.S. Cl. ..... 315/291; 315/194; 315/294
(58) Field of Search ..... 315/194, 291, 315/294, DIG. 4; 359/181

(56) References Cited

U.S. PATENT DOCUMENTS

| | | | | |
|---|---|---|---|---|
| 3,900,404 | | 8/1975 | Dachs | 250/199 |
| 5,107,184 | * | 4/1992 | Hu et al. | 315/291 |
| 5,544,037 | | 8/1996 | Luger | 364/146 |
| 5,550,434 | | 8/1996 | King et al. | 315/160 |
| 5,657,145 | | 8/1997 | Smith | 359/181 |
| 5,838,116 | | 11/1998 | Katyl et al. | 315/307 |
| 5,925,990 | | 7/1999 | Crouse et al. | 315/307 |
| 6,008,586 | | 12/1999 | Norman | 315/94 |

FOREIGN PATENT DOCUMENTS

| | | |
|---|---|---|
| 2200021 | 9/1998 | (CA) . |
| 456462 | 11/1991 | (EP) . |
| WO 98/02846 | 1/1998 | (WO) . |
| WO 99/23858 | 5/1999 | (WO) . |
| WO 99/53732 | 10/1999 | (WO) . |

OTHER PUBLICATIONS

Data Sheet IR2101 pp. 1, 4, 5; ©3/99.
Data Sheet SG2535 pp. 1, 2, 7; ©7/98.
Data Sheet ST62T30 pp. 1–7; ©9/98.

* cited by examiner

*Primary Examiner*—David Vu
(74) *Attorney, Agent, or Firm*—Paul F. Wille

(57) ABSTRACT

A digitally controlled electronic ballast, on command, optically transmits its identification signature or other data by CW modulation of the luminosity of one or more lamps connected to the ballast. The data is transmitted by momentarily interrupting the lamp current to mark the beginning and the end of successive periods, wherein the periods represent either a logic one or a logic zero in accordance with the data to be transmitted. Each ballast has a unique identification, which is included in the transmitted digital data. A receiver monitors the luminosity of a lamp and compares instantaneous luminosity to average luminosity to detect the beginning and end of each period.

12 Claims, 3 Drawing Sheets

LIGHT MODULATING ELECTRONIC BALLAST

BACKGROUND OF THE INVENTION

This invention relates to an electronic ballast and, in particular, an electronic ballast that imperceptibly modulates light output by interrupting power to one or more fluorescent lamps.

A fluorescent lamp is an evacuated glass tube with a small amount of mercury in the tube. The tube is lined with an adherent layer of a mixture of phosphors. Some of the mercury vaporizes at the low pressure within the tube and a filament or cathode sealed in each end of the tube is heated to emit electrons into the tube, ionizing the gas. A high voltage between the filaments causes the mercury ions to conduct current, producing a glow discharge that emits ultraviolet light. The ultraviolet light is absorbed by the phosphors and re-emitted as visible light. After the glow discharge terminates, the phosphors glow for a small but finite time known as persistence. Similarly, the glow discharge continues for an even smaller but finite time after power is removed.

A fluorescent lamp is a non-linear load to a power line, i.e. the current through the lamp is not directly proportional to the voltage across the lamp. Current through the lamp is zero until a minimum voltage is reached, then the lamp begins to conduct. Once the lamp conducts, the current will increase rapidly unless there is a ballast connected to the lamp for limiting current.

An electronic ballast typically includes a rectifier for changing the alternating current (AC) from a power line into direct current (DC) and an inverter for changing the direct current into alternating current at high frequency, typically 25–60 kHz. Some ballasts include a boost circuit between the rectifier and the inverter.

Modern electronic ballasts perform the basic function of ballasting a fluorescent lamp significantly better than ballasts of just a decade ago in terms of power factor, efficiency, and the like. As typical with other electronic devices, electronic ballasts are now expected to perform an increasing number of additional functions. For example, many techniques have been proposed for dimming lamps by communicating over power lines or by communicating over a separate line to each ballast.

Other proposals, such as disclosed in U.S. Pat. No. 5,838,116 (Katyl et al.), include transmitting information from a fluorescent lamp by modulating the light from the lamp. The modulation described in the patent includes frequency modulation (FM) and amplitude modulation (AM). AM is obtained by interfering with the regulation of the boost circuit, thereby increasing the voltage of the high voltage rail in the inverter to increase light output momentarily.

Suitable photodetectors are a necessary part of the combination but are not described in detail in the Katyl et al. patent. Their existence and a variety of functions are merely attributed to certain blocks in a block diagram. It turns out that reliably detecting the modulation is not particularly easy. Interference from other light sources is a problem, as is signal to noise ratio in general. A strong, nearby signal tends to overload a detector and a weak, distant signal tends to become lost in noise.

Typically in the prior art, increased functionality is obtained only by increasing the complexity, and cost, of the ballast circuit. On the other hand, even if a particular function could be "free," it is inevitable that additional functions will be wanted. It is desired to provide those functions at minimal extra cost.

An advantage of digitally controlled dimmable ballasts is that the ballasts can be grouped for setting scenes or for locally brightening or dimming a part of a room. For this purpose, some dimming ballasts sold by Energy Savings, Inc. of Schaumburg, Illinois U.S.A. had an eight-way switch externally accessible on the ballasts. Depending on the setting of the switch, a ballast was assigned to one of eight possible zones. A scene could then have zone one at fifty percent of full brightness, zone two at seventy-five percent, and so on. This arrangement, while considerably better than changing the wiring in the building, still has the disadvantage of requiring physical access to the ballast.

It is possible to assign a unique number or identification (ID) to every ballast during manufacture. Each ballast can be addressed by ID and the control of scenes and zones can all be in one central unit. In theory, the ID would be written on a sticker and the sticker would be placed upon a fixture to show the ID. In practice, the chance of the ID being lost is quite high. Without any way to retrieve the information, the system capability would be lost or at least the fixture would have to be replaced.

In Europe, a system known as DALI, (digital addressable lighting interface) is being proposed. In this system, each ballast is given an ID at the factory and the ballasts are interrogated at the installation site to determine ID. After interrogation, the operator tells the controller to light up a first set of lamps and then the operator goes around the rooms and writes on a map where the lamps are lit. The process is repeated until all IDs are plotted on a map.

In view of the foregoing, it is therefore an object of the invention to provide a technique for modulating light output without additional circuitry in a digitally controlled electronic ballast.

Another object of the invention is to provide an electronic ballast that can identify itself readily by modulating the light output from one or more lamps coupled to the ballast.

A further object of the invention is to provide a detector for reliably converting modulated light from a fluorescent lamp into a series of pulses.

Another object of the invention is to provide two-way communication with a ballast with minimal additional circuitry.

A further object of the invention is to simplify the on-site identification of uniquely identified electronic ballasts.

SUMMARY OF THE INVENTION

The foregoing objects are achieved in this invention in which data is transmitted by CW modulation of the luminosity of one or more lamps connected to a ballast. The ballast includes an inverter section and the data is transmitted by momentarily turning off lamp current to mark the beginning and the end of successive periods, wherein the periods represent either a logic one or a logic zero in accordance with the data to be transmitted. Preferably, each ballast has a unique identification, which is included in the transmitted digital data. A receiver monitors the luminosity of a lamp and compares instantaneous luminosity to average luminosity to detect the beginning and end of each period. A two wire conductor system is connected to all the ballasts to convey digital information from a central control.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
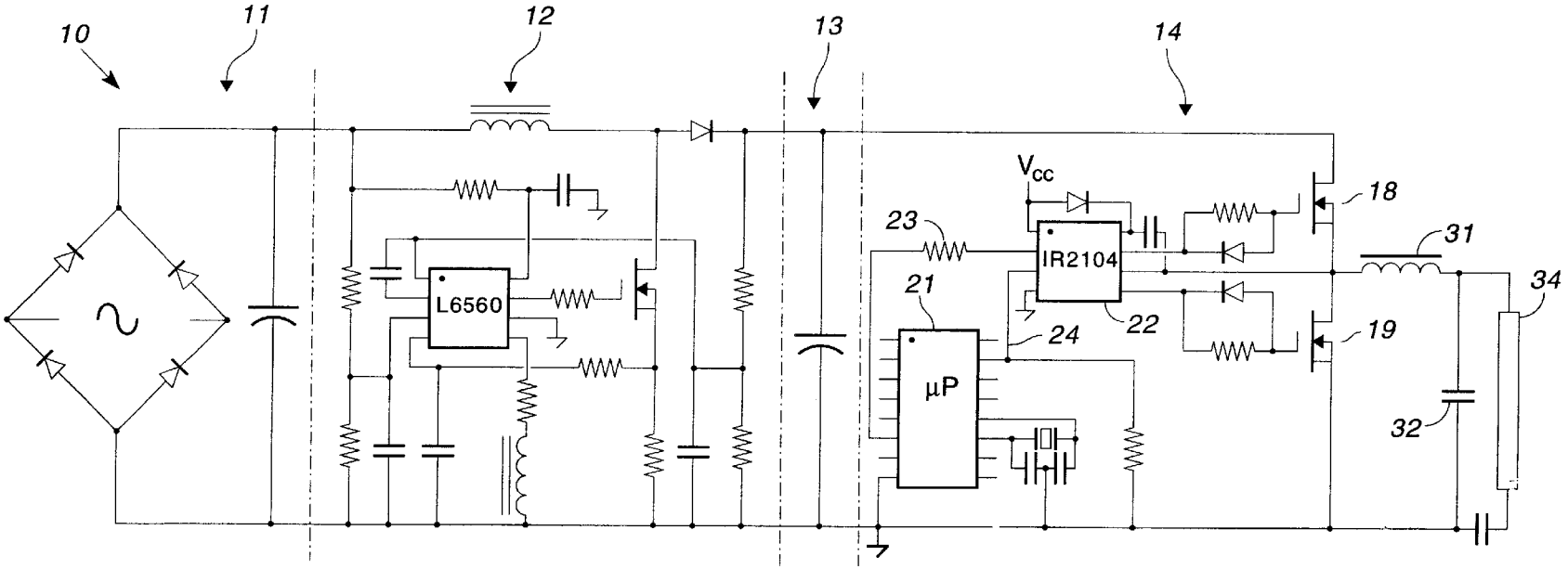
FIG. 1 is a schematic diagram of a ballast constructed in accordance with the invention.

FIG. 1 illustrates a microprocessor controlled ballast suitable for implementing the invention. FIG. 1 is the same as FIG. 2 in U.S. Pat. No. 5,925,990 (Crouse et al.). In FIG. 1, pin 1 of the integrated circuits is indicated by a small dot and the pins are numbered consecutively counterclockwise. Ballast 10 includes converter section 11 for producing DC from line voltage, boost section 12 for increasing the DC voltage, storage section 13 for storing energy to drive a lamp, and inverter section 14 for driving a lamp.

In one embodiment of the invention, boost section 12 includes a boost controller implemented as an L6561 power factor correction circuit as sold by SGS-Thomson Microelectronics. Boost section 12 is essentially the same as the circuit recommended in the data sheets accompanying the L6561 integrated circuit.

Microprocessor 21 is coupled to two inputs of driver circuit 22. Specifically, high frequency pulses are coupled through resistor 23 through pin 2 of driver circuit 22. Pin 3 of driver circuit 22 is a disable input and is coupled to an output of microprocessor 21 by line 24. When disable line 24 is brought low, drive circuit 22 is shut off. Otherwise, drive circuit 22 causes transistors 18 and 19 to conduct alternately at the frequency on pin 2. The junction of transistors 18 and 19 is coupled through series resonant inductor 31 and capacitor 32 to common. Fluorescent lamp 34 is coupled in parallel with capacitor 32 in what is known as a half bridge, series resonant, direct coupled output.

As described in the Crouse et al. patent, disable line 24 is brought low in response to a detected fault. In accordance with the invention, microprocessor 21 is programmed to bring disable line 24 low and then high to interrupt lamp current and thereby modulate light output.

Figure 2:
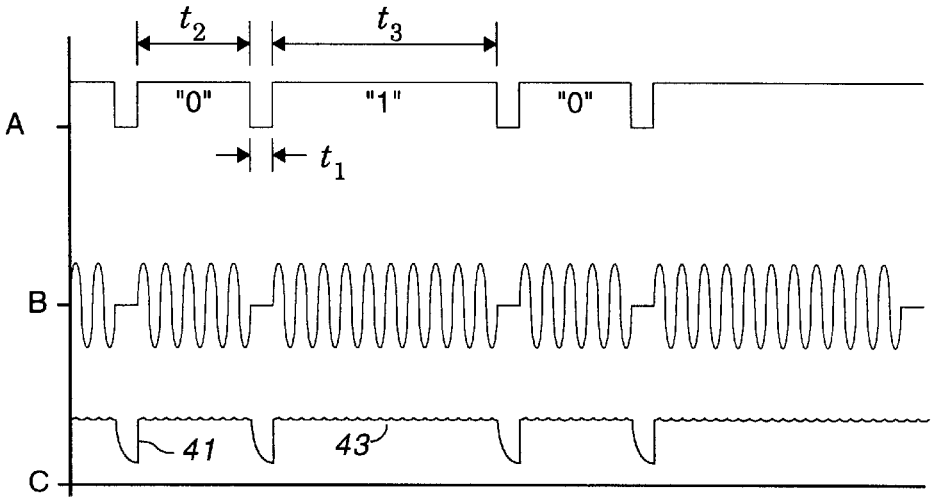
FIG. 2 is a chart of three waveforms illustrating the operation of the invention.

FIG. 2 is a chart of waveforms illustrating the operation of an electronic ballast in accordance with the invention. Waveform "A" represents the voltage on disable line 24. The inverter is disabled for a sufficient time for the light to decrease enough to be detected reliably by a photodetector circuit. This time depends upon the persistence of the phosphors and the glow discharge but is generally quite short for most fluorescent lamps. A pulse width, $t_1$, of 150 microseconds has been found sufficient for reliable communication from a ballast.

Waveform "B" illustrates the high frequency current through a lamp and the missing cycles when the inverter is disabled. Waveform "C" illustrates the brightness of the lamp, somewhat exaggerated for clarity. Luminosity decreases when lamp current is interrupted, as indicated by notch 41, but does not go to zero. The decrease in luminosity is greater than the decrease between cycles of the high frequency current, represented as ripples in generally horizontal line 43. Thus, the inverter is shut off long enough to produce a distinct signal.

As illustrated by waveform "A", logic zeroes and ones are represented by the time interval between pulses. Thus, the modulation is "continuous wave" (CW), as used to transmit Morse code. Amplitude or luminosity does not itself carry any information. The information is contained in the time between pulses. Thus, the invention is also completely independent from the operating frequency of the inverter.

In a preferred embodiment of the invention, a logic zero is represented by an interval, $t_2$, of one millisecond and a logic one is represented by an interval, $t_3$, of two milliseconds. Thus, assuming an equal number of ones and zeroes, a sixteen bit ID can be transmitted in 26.55 milliseconds. Other intervals could be used instead. A pulse width of one or two milliseconds may be perceptible to some people. A pulse width less than one millisecond is generally imperceptible.

Figure 3:
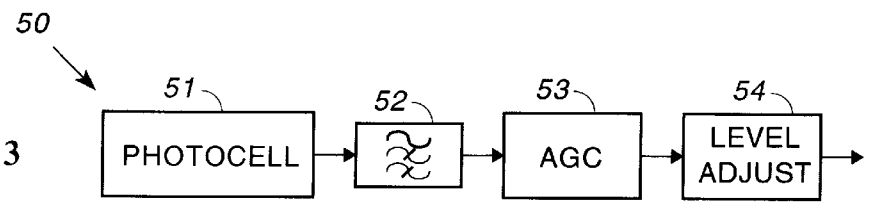
FIG. 3 is a block diagram of a detector constructed in accordance with the invention.

FIG. 3 is a block diagram of a photodetector constructed in accordance with another aspect of the invention. Photodetector 50 includes photocell 51 for converting light into voltage, high pass filter 52 for removing extraneous signals, automatic gain control circuit 53 for adjusting gain in accordance with the overall brightness of a room, and level adjusting circuit 54 for providing the appropriate voltages to a microprocessor (not shown). The output from circuit 54 is essentially a reconstruction of waveform "A" (FIG. 2). Additional circuitry (not shown) converts the pulses into digital data and displays the data for a user. Such additional circuitry is well known in itself.

Figure 4:
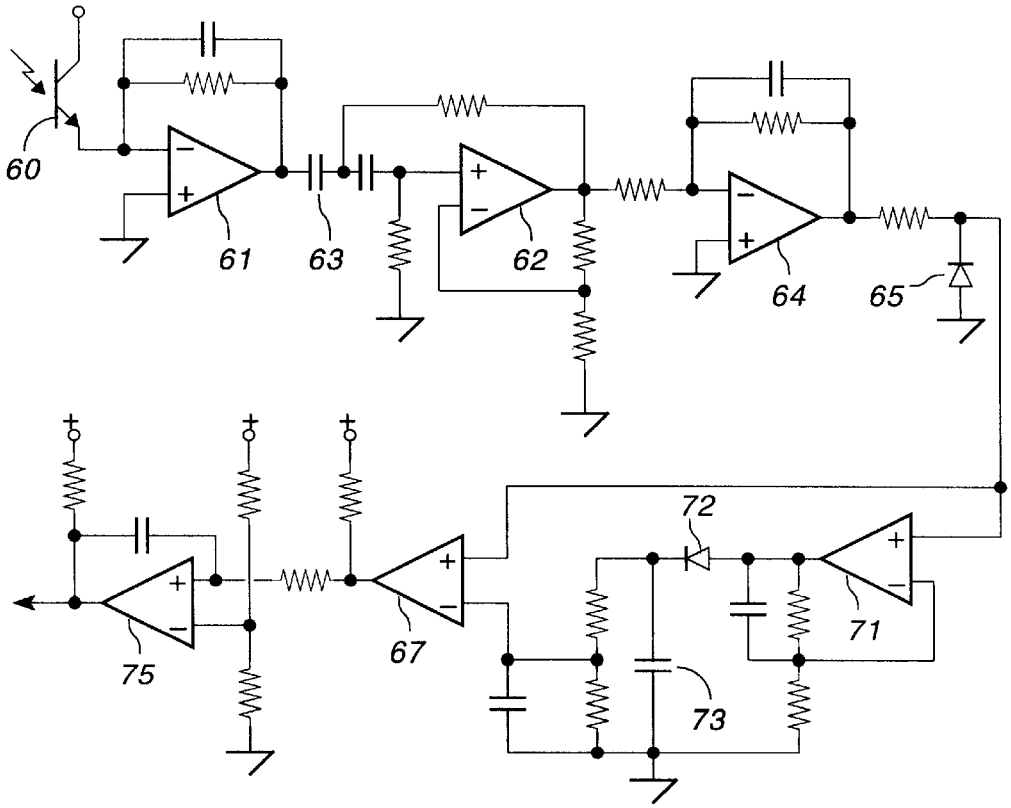
FIG. 4 is a schematic diagram of a detector constructed in accordance with a preferred embodiment of the invention.

FIG. 4 is a schematic of a photodetector constructed in accordance with a preferred embodiment of the invention. Phototransistor 60 converts incident light to current and is coupled to the inverting input of amplifier 61, which converts the current to voltage. Amplifier stage 62 is a second order high pass filter and is coupled to the output of amplifier 61 through DC blocking capacitor 63. Amplifier 64 provides a gain of about ten. Shottky diode 65 clamps the output positive, allowing only positive pulses to pass to the next stage.

The output from amplifier 64 is coupled directly to the non-inverting input of comparator 67 and indirectly to the inverting input of the comparator by way of an averaging circuit including low pass filter 71, rectifier 72, and capacitor 73. Comparator 67 compares the pulses to a variable reference voltage provided by the average of the signal from phototransistor 60. This enables the photodetector to accommodate taking readings at various distances from the lamps.

The output from comparator 67 is a series of pulses that are cleaned up in one-shot multivibrator 75. The pulses are then coupled to additional circuitry (not shown) for converting the periods between pulses to logic ones and zeros and for displaying the resulting data, in either binary form or alphanumeric form. The additional circuitry is well known in itself. In one embodiment of the invention, the additional circuitry was sensitive to the leading edge of a pulse. Thus, "the period between pulses" is not to be interpreted absolutely literally but understood to depend upon the particular hardware used.

To use the invention, one broadcasts a command to all ballasts in a system, e.g. on a branch circuit, to transmit their ID numbers. The command is preferably broadcast by a low voltage control wire coupled to all the ballasts. Alternatively, a ballast could automatically transmit its ID for a predetermined period after power is applied to the ballast. An operator then walks around with a small battery powered photodetector to read the ID's from the light modulations of each fixture and record the identity and position of each fixture. Fixtures with plural ballasts would require some adaptation of the photodetector to limit the field of view to one lamp. The simplest optics is a snap-on tube to restrict the field of view of the phototransistor; in effect, collimating the light from a lamp. Unless a fixture or a ballast is replaced, the photodetector is used only once and could be loaned for use as required or given to a large customer as a promotional item.

Once a ballast can "talk," it is inevitable that customers will want the ballast to say more than just its ID. A microprocessor controlled ballast constructed in accordance with the invention can implement one-way communication without additional hardware. For two-way communication, some additional hardware is needed.

Figure 5:
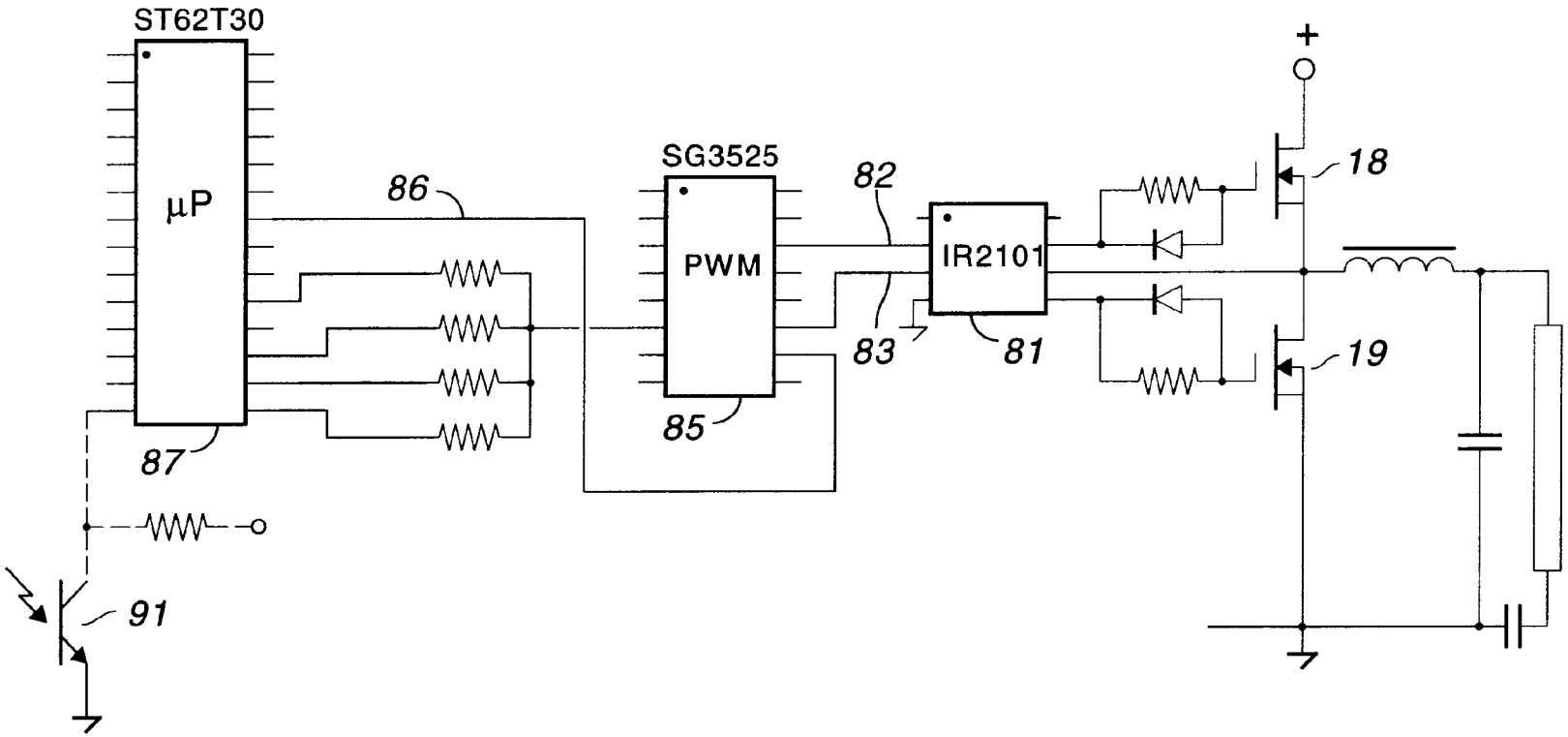
FIG. 5 is a schematic of the inverter section of a ballast constructed in accordance with a preferred embodiment of the invention.

FIG. 5 is a schematic of the inverter section of an electronic ballast constructed in accordance with a preferred embodiment of the invention. Driver 81 causes transistors 18 and 19 to conduct alternately but the driver has no shutdown pin as in the embodiment of FIG. 1. Driver 81, an IR2101 high and low side driver, is a simpler device than driver 22 (FIG. 1) and is controlled by pulse width modulator 85, which does have shutdown capability. Line 86 couples one bit of an output port of microprocessor 87 to pin ten of pulse width modulator 85. Pin ten is one of several pins that effect shutdown and more than one device may be coupled to a pin for effecting shutdown. The several resistors coupled to pin six control the switching frequency of the inverter.

The CW modulation of light output is the same as described for the circuit of FIG. 1 except that the disable input of pulse width modulator 85 is active high rather than active low.

In addition to transmitting information, a ballast constructed in accordance with FIG. 5 can also receive information. Phototransistor 91 converts incident light into a current. Appropriate processing circuitry, not shown in FIG. 5, couples transistor 91 to an input port of microprocessor 87 for receiving pulses representing digital data.

A hand-held infra-red transmitter (not shown) is pointed at the ballast, which includes an optical port for transistor 91. Data, commands, or address information can be sent to the ballast, e.g. to organize a plurality of such ballasts into a zone, to request transmission of an ID, to request the time since the last re-lamping, and so on. Flash memory or EEPROM is used in the ballast to store received data that must survive a power outage. Two way communication also enables upgrading a microprocessor controlled ballast by downloading the latest software optically; e.g. tables representing data for new lamp types.

Another feature of the invention is that the handheld unit is capable of transmitting an infrared signal encoding the address just received from the ballast, together with another number representing the zone. For example, an operator is setting up a lighting zone and the handheld unit is set to the number of the zone. The operator receives the ID of a ballast and then points at a wall mounted controller, triggering the handheld unit to transmit the zone number and the ballast ID to the controller. In this way the operator never has to record manually the ID of the ballast, which might be a very long number. This procedure is repeated for each zone and each ballast. The operator simply assigns the ballasts to the zones and sends the ballast ID to the controller along with the zone number for each ballast. The worst case would be where the controller is not visible from the location of the operator and the handheld unit has to be moved to a position with a line of sight to the controller. It is also possible for all addresses and zone assignments to be stored in the hand-held unit and then transmitted all at once as a large packet.

The invention thus provides a technique for modulating light output without additional circuitry in a digitally controlled electronic ballast. The ballast can identify itself readily by modulating the light output from one or more lamps coupled to the ballast. A detector is provided for reliably converting modulated light from a fluorescent lamp into a series of pulses, thereby simplifying the on-site identification of uniquely identified electronic ballasts. In addition, two-way communication with a ballast is accomplished with minimal additional circuitry.

Having thus described the invention, it will be apparent to those of skill in the art that various modifications can be made within the scope of the invention. For example, although lamp 34 is illustrated as an instant start lamp, the invention can be used with any type of gas discharge lamp. The particular semiconductor devices identified are part of a preferred embodiment of the invention. Other devices could be used instead. The lamp current could be interrupted using any kind of switch instead of turning off the inverter. The digital data can include error detection or correction data in addition to the desired message. The data may also include end of life measurements upon the lamps, a history of recent faults detected, and hours run data for the lamps.

What is claimed as the invention is:

1. A method for communicating with an electronic ballast, said ballast driving at least one gas discharge lamp with a driver controlled by one or more low voltage signals, said method comprising the steps of:

(a) applying a high frequency alternating current to said lamp;

(b) momentarily interrupting lamp current with a low voltage signal to the driver to mark the beginning and the end of a first period to represent a logic one;

(c) momentarily interrupting lamp current with a low voltage signal to the driver to mark the beginning and the end of a second period to represent a logic zero; and (d) performing steps (b) or (c) in a sequence to represent a predetermined group of bits of digital data.

2. The method as set forth in claim 1 wherein the lamp current is turned off once between periods.

3. The method as set forth in claim 1 wherein the lamp current is turned off for a period imperceptible to the average person.

4. A method for communicating with an electronic ballast, said ballast driving at least one gas discharge lamp, said method comprising the steps of:

(a) applying a high frequency alternating current to said lamp;

(b) momentarily interrupting lamp current to mark the beginning and the end of a first period to represent a logic one;

(c) momentarily interrupting lamp current to mark the beginning and the end of a second period to represent a logic zero;

(d) performing steps (b) or (c) in a sequence to represent a predetermined group of bits of digital data;

converting variations in the luminosity of the lamp to a first voltage;

comparing the first voltage to a second voltage representing the average luminosity of the lamp to detect the beginning and end of each period;

producing pulses to represent the beginning and the end of each period; and converting the time between pulses to received data.

5. The method as set forth in claim 4 wherein the ballast includes a circuit for sensing incoming data and further comprising the step of:

performing step (d) in response to the incoming data.

6. The method as set forth in claim 4 and further including the step of:

retransmitting the received data.

7. In a process for transmitting digital data from a fluorescent lamp by modulating the light emitted by the lamp, the lamp being driven by an electronic ballast having an inverter section, the improvement comprising the step of:

transmitting digital data by CW modulation of the output of the inverter.

8. The process as set forth in claim 7 wherein said CW modulation includes the steps of:

momentarily turning off the inverter section to mark the beginning of a first period;

momentarily turning off the inverter section to mark the end of the first period and the beginning of a second period; and continuing to momentarily turn off the inverter section to mark the ends and beginnings of successive periods, wherein the periods represent either a logic one or a logic zero in accordance with the data to be transmitted.

9. The process as set forth in claim 7 wherein the ballast has a unique identification, which is included in the transmitted digital data.

10. An electronic ballast that can modulate light to communicate information, said ballast including an inverter section for driving at least one gas discharge lamp and a microprocessor for controlling said inverter section, wherein said microprocessor is programmed to:

(a) momentarily turn off the inverter section to mark the beginning and the end of a first period to represent a logic one;

(b) momentarily turn off the inverter section to mark the beginning and the end of a second period to represent a logic zero; and (c) repeat (a) or (b) in a sequence to transmit said information.

11. The ballast as set forth in claim 10 wherein said microprocessor turns off the inverter section once between periods.

12. The ballast as set forth in claim 10 wherein the microprocessor turns off the inverter section for a period imperceptible to the average person.

* * * * *